United States Patent [19]

Brzezinski et al.

[11] 4,306,724

[45] Dec. 22, 1981

[54] BOARD GAME APPARATUS

[75] Inventors: Stephen R. M. Brzezinski, 827 Kosciuszko, South Bend, Ind. 46619; Peggy J. Brzezinski, South Bend, Ind.

[73] Assignee: Stephen R. M. Brzezinski, South Bend, Ind.

[21] Appl. No.: 70,727

[22] Filed: Aug. 29, 1979

[51] Int. Cl.[3] ..... A63F 3/00

[52] U.S. Cl. ..... 273/243; 273/272

[58] Field of Search ..... 273/272, 256, 243

[56] References Cited

U.S. PATENT DOCUMENTS

| | | | |
|---|---|---|---|
| 3,152,806 | 10/1964 | Jackman | 273/272 |
| 3,606,336 | 9/1971 | Krause | 273/272 |
| 3,655,195 | 4/1972 | Bean | 273/272 |
| 3,973,775 | 8/1976 | Bolan | 273/253 |
| 4,055,347 | 10/1977 | Kreischer | 273/273 |

FOREIGN PATENT DOCUMENTS

| | | | |
|---|---|---|---|
| 747598 | 4/1956 | United Kingdom | 273/272 |
| 801964 | 9/1958 | United Kingdom | 273/243 |
| 1384848 | 2/1975 | United Kingdom | 273/244 |

*Primary Examiner*—Richard C. Pinkham
*Assistant Examiner*—Carl Moy
*Attorney, Agent, or Firm*—Craig and Antonelli

[57] ABSTRACT

A board game apparatus is provided which combines advantageous features from business and crossword games, as well as other games. A board is provided which includes an inner area divided up into spaces for accommodating formation of words from letter pieces. Surrounding the inner area are a plurality of spaces defining a travel path for player pieces, which spaces include indicia referring the players landing thereon to respective bonus, penalty and category cards which will control their next step in forming words in the center area. Play money certificates are utilized to accumulate the player's scores, based upon the letter value of words formed, and also to accommodate purchase of additional letters under certain conditions, as well as penalty payments. The throw of dice control the movement of the player pieces along the outer portion of the board.

23 Claims, 13 Drawing Figures

BOARD GAME APPARATUS

BACKGROUND AND SUMMARY OF THE INVENTION

The present invention relates to board game apparatus of the type wherein letter pieces are used to build words. Prior art board games which the present invention is directed at improving include the well-known crossword games sold by Selchow and Righter under its registered trademark SCRABBLE and the game sold by Parker Brothers under its registered trademark MONOPOLY. These prior art games have met with considerable success and are educational and entertaining for those who use them. However the present invention is concerned with improving upon these prior art games by including features which better test and enhance multiple skills of the players, while also being adaptable to many different skill levers.

U.S. Pat. No. 4,055,347 discloses a board game apparatus which includes a continuous path on which game pieces are moved, which path includes primarily letters. Letter pieces corresponding to the letters on the path are then used by the players to form words on their own separate individual word-forming boards. The letters are assigned dollar values and the players are given a predetermined amount of play money which they use to purchase the letters. The movements of the game pieces along the path are controlled by the throw of dice. Certain of the positions along the player piece path also include instructions to collect a bonus or to draw cards, which cards give bonus moves, letters, or money. Although this board game utilizes the combination of the use of money certificates with a word forming game, it doesn't have a common word forming board used by multiple players alone the lines of the crossword game product sold under the trademark Scrabble ®. Furthermore, the players options with this game as far as forming words are concerned are controlled by the letters that come into their possession.

U.S. Pat. No. 3,396,972 discloses another word forming game apparatus wherein the letter pieces are of different shapes and mate along different edges so as to provide bonus points in certain combinations. This game also has somewhat more variety than the basic crossword game product sold under the trademark Scrabble ® game, however, the optional choices the players may make are controlled, again, primarily by the letters which come into their possession.

There are other board games, not involving word formation, which utilize multiple board spaces along which a player piece is moved, which spaces indicate certain actions that can and must be taken to accomplish the purpose of the game. Exemplary of such games are the espionage game of U.S. Pat. No. 3,951,411 and the space war game of U.S. Pat. No. 3,973,775. Although these last-mentioned games are entertaining and interesting, they do not test and enhance the players' vocabulary skills as do word formation games of the type the present invention is directed at improving.

According to one feature of the present invention, a board game is provided which includes two different board areas, the first board area being used for accommodating formation of words from letter pieces and the second board area accommodating movement of player pieces along a predetermined path. The second board area spaces include indicia for controlling the players' activities, including word forming operations, as a function of the particular space landed upon by the player's playing piece. In preferred embodiments, the movement of the player pieces along the path in the second board area is controlled by random control means such as the roll of dice. With this combination of features, interesting variants in the conventional crossword game product sold under the trademark Scrabble ® are provided since the particular space landed upon by the playing piece in the second board area includes indicia which control the player's options as far as the type or category of word that may be formed in the first board area. In preferred embodiments, the second board area includes spaces with indicia instructing its player to make a word without regard to category as well as spaces with indicia instructing the player to draw a category card from a prearranged stack of same. In those instances where the player piece lands on a space requiring selection of a category card, the player then is faced with another test of his or her vocabulary, since the various categories can be designed so as to require understanding of words in many diverse subjects. For example, a mechanic may be very skilled at forming names of tools and equipment, but will be stumped when a subject such as "astronomical terms" is imposed. On the other hand, an astronomer may well have a more limited vocabulary when it comes to tool names than does a mechanic.

In particularly preferred embodiments of the game apparatus of the present invention, a timer, such as an egg timer or a stop watch, is provided for timing the step of word formation by a player. In these embodiments, both the mental speed and acuity are tested and enhanced, since a player must very quickly form words or lose his or her turn. In preferred embodiments, it is recommended that a maximum time limit of three minutes or less be imposed, to commence as soon as a category card is selected or as soon as the player piece lands on a space permitting word formation without regard to category. This time limitation, coupled with the random control of category limitations, provides for a very advantageous interesting and exciting fast pace.

The random imposition of category limitations can be taken into account by very skilled players since they can anticipate categories and words which will fit together with the words already formed on the board, based on the play of previous category cards and letter pieces, thus gaining additional effective time to compose letters as compared to less experienced or skilled players which can not really anticipate such matters. These features make the game particularly attractive to very intelligent players, since they can utilize both their vocabulary and strategy skills to gain advantage over their opponents. Also, these features prevent even the most skilled and experienced players from being bored with the game.

In particularly preferred embodiments, the letter pieces are assigned different point or dollar values, dependent on the frequency of their use in forming words, thus placing a premium on word formation using particular seldom used letters in a player's possession. In preferred embodiments, play money or point certificates are utilized to keep track of the points earned by the players and also to give the players the opportunity to purchase letters from one another and from a central bank of play money point certificates under certain conditions. In this way, certain advantageous aspects of the game of MONOPOLY are incorporated into the game of the present invention. This feature of using play money point certificates tests and enhances yet further skills, since successful players must anticipate the relative worth of other letters vis-a-vis their costs ($), while also considering the letters already in their possession and already in position on the word forming board area. The utilization of play money certificates to monitor the players progress during a game is advantageous because it dispenses with the need for intricate written score keeping and also graphically apprises each player of their relative success.

Certain advantageous preferred embodiments of the invention include spaces on the second board area which direct players having playing pieces land thereon to draw from a stack of bonus cards or a stack of penalty or library fine cards. With these features, the element of chance is further interjected into the game on a random basis, while not detracting from the basic multiple skill aspects of the game. In certain preferred embodiments, at least one spinner is also provided at one of the spaces on the player piece path, which spinner effects a second random chance control means which the player must cope with at intermittent intervals.

The various features and combinations of features of the board game apparatus of the present invention make the game particularly adaptable to various skill levels, as long as all players playing the game at one time are of commensurate skill. The adaptability of the game apparatus of the present invention is enhanced by inclusion of different sets of category cards of varying levels of difficulty. For example, if young children are to play the game, a set of category cards could be selected so as to include only very broad, well-known categories of things or places, such as "animals", "birds" and "towns or cities". On the hand, for players with advanced skills and larger vocabularies, a set of category cards with more restrictive and difficult categories could be selected, such as "surnames of U.S. senators", "one word book titles", "surnames of famous left-handed people", or the like.

With the board game apparatus of the present invention, the effect of elements of chance can also be controlled by appropriate selection of the penalty and bonus cards. For example, for young children of diverse abilities, it may be desirable to increase the elements of chance so that poorer players have the opportunity to succeed. This can easily be done by having the bonus and penalty cards play a very significant role in the outcome of the game by giving or taking away substantial points or dollar amounts. On the other hand, for highly educated and skilled players of commensurate ability who desire to engage in a game primarily of skill, the penalty and bonus cards can be so selected as to minimize their impact on the outcome of the game, while still introducing a certain element of chance.

These and further objects, features and advantages of the present invention will become more obvious from the following description when taken in connection with the accompanying drawings which show, for the purposes of illustration only, a single embodiment in accordance with the present invention.

DETAILED DESCRIPTION OF THE DRAWINGS

Figures 1A, 1B:
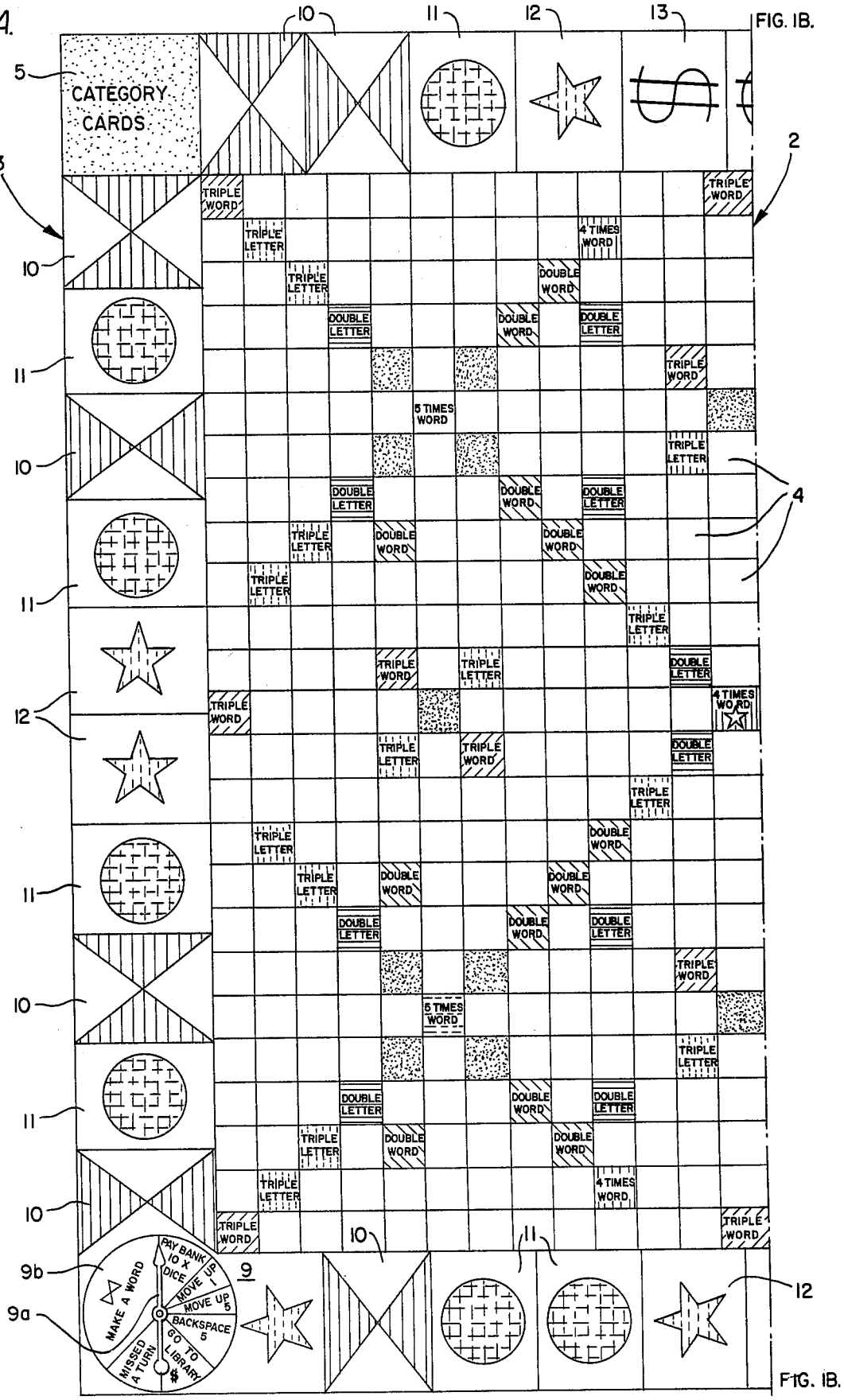
FIGS. 1*a* and *b* combined is a plan view of a game board constructed in accordance with a preferred embodiment of the present invention.
Figure 1B:
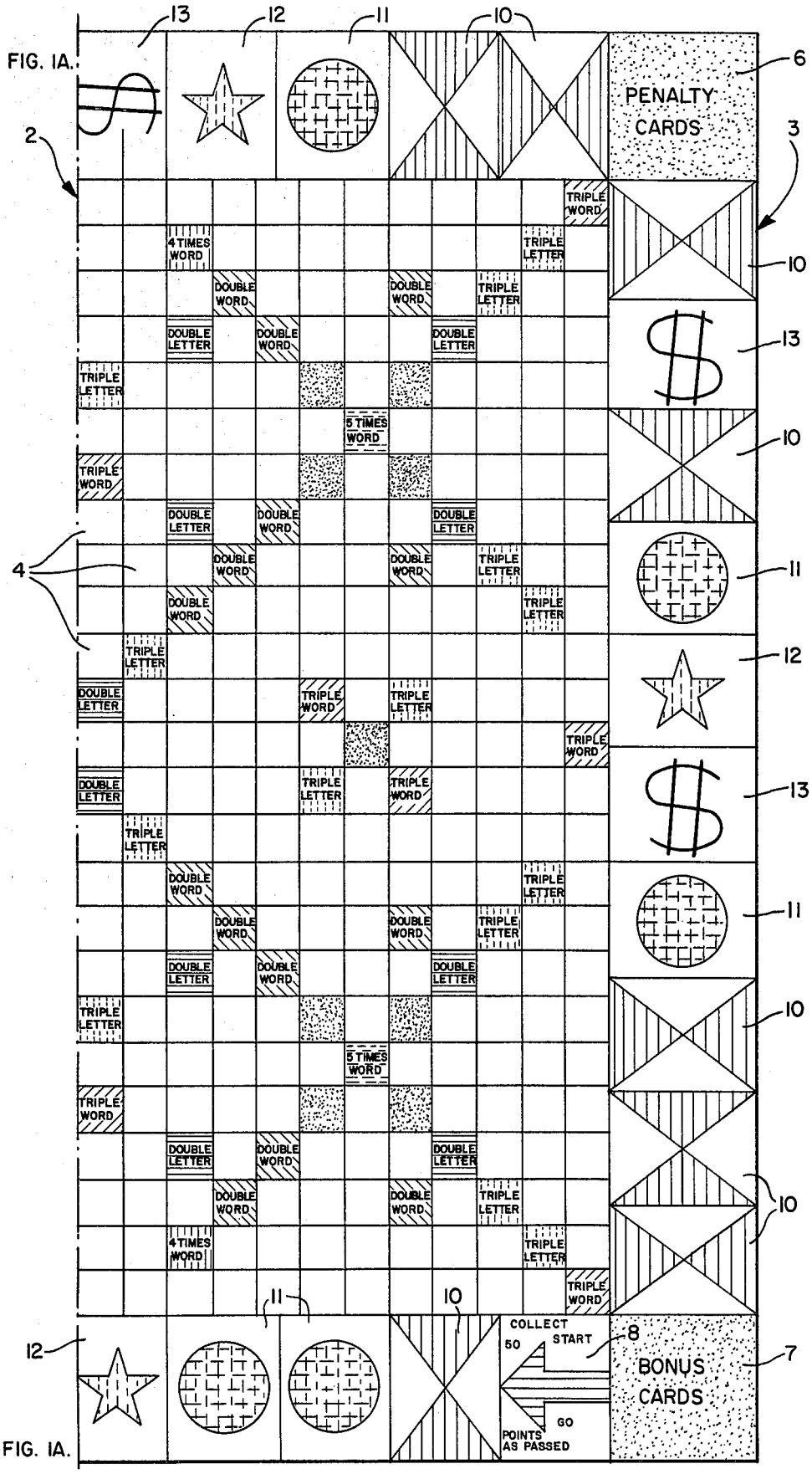

FIG. 1 illustrates the game board constructed in accordance with the present invention, which board is to be constructed of sufficient rigidity so as to accommodate its use as a game board with placement and movement of pieces thereon. Additionally the game board is preferably mounted on a "lazy susan" type rotatable support, not shown, so as to accommodate movement of the game board for a plurality of individual players positioned therearound during the play of the game. The board 1 is divided into an inner board portion 2 and an outer board portion 3.

The inner board portion 2 is divided into 625 squares 4 arranged in a square grid of 25 squares by 25 squares. These squares 4 are configured to accommodate positioning thereon of letter pieces, to be described below, which letter pieces are arranged to form words, much in the manner of the well-known crossword game product sold under the trademark Scrabble®. Certain of the squares 4 are colored, with the colored squares being arranged in a predetermined pattern consisting of nine intersecting "X" patterns symmetrically allocated over the surface of the board. These colored squares are used to differentiate multiple values that are to be given to letters and/or words placed thereon. In the preferred embodiment illustrated, colored squares are provided to depict double value letter, triple value letter, five times letter, double word, triple word, four times word, and five times word valuations, with all squares of the same value being of the same color, but with different colors depicting each of the respective multiple value spaces.

The outer board portion 3 includes 44 spaces. The upper left-hand corner space 5 is configured for accommodating a stack of category cards to be described below. The upper right-hand corner 6 is configured to accommodate a stack of penalty cards to be described below, and the lower right corner space 7 is configured to accommodate a stack of bonus cards to be described below. Immediately to the left of space 7, start space 8 is provided. In the lower left corner, a multiple gamble space 9 is provided which includes a rotatable spinner 9*a* attached to the board to be spun by hand so as to come to rest in one of the segments of the spinner circle 9*b*.

The remaining spaces on the outer board portion include respective geometric and color indicia for each of free choice spaces 10; category spaces 11; bonus spaces 12; and penalty spaces 13. In the preferred embodiment illustrated, the penalty spaces 13 include a dollar sign ("$") to graphically depict the library dues or penalty fine to be assessed against the player landing thereon, while the bonus spaces 12 include a colored star graphically depicting the "bonuses" to be received by a player landing thereon, as described in more detail below.

Figure 2:
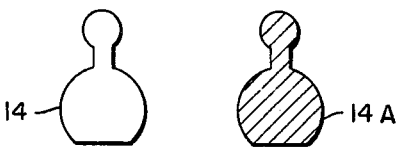
FIG. 2 is a perspective view of exemplary player pieces for use with the present invention.

FIG. 2 graphically depicts a pair of player pieces 14, 14A, with the game apparatus of the invention including a plurality of such player pieces of different configuration and/or color, which player pieces are sized so as to be movable between and placed in the respective spaces 8–13 at the outer board portion 3. These player pieces 14, 14A are preferably made of wood or plastic and are sufficiently rigid to accommodate repetitive usage thereof and handling thereof by the players.

Figure 3:
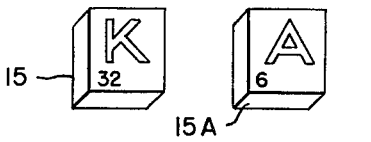
FIG. 3 is a perspective view of exemplary letter pieces for use with the present invention.

FIG. 3 graphically depicts a pair of representative letter pieces 15, 15A which letter pieces are sized so as to fit within the confines of the respective spaces 4 of the inner board portion 2. These letter pieces 15, 15A also are preferably made of wood or plastic and are sufficiently rigid to accommodate repetitive usage thereof and handling thereof by the players. Each of the letters 15, 15A has a specific predetermined point value, with the number of letters and point value being selected as a function of the frequency with which such letters occur in the formation of words in whatever language the game is to be played. In preferred embodiments involving English language usage, the frequency with which letters occur in the formation of the words is predetermined from an analysis of dictionary compilations. Using these criteria, the game apparatus of preferred embodiments of the present invention include the following letters and numbers of letters having the following point or dollar values:

| Number | Letter | Points Or Dollars Each |
|---|---|---|
| 36 | A | 6 |
| 8 | B | 12 |
| 8 | C | 12 |
| 16 | D | 8 |
| 48 | E | 3 |
| 8 | F | 20 |
| 12 | G | 12 |
| 8 | H | 8 |
| 36 | I | 6 |
| 4 | J | 32 |
| 4 | K | 32 |
| 16 | L | 10 |
| 8 | M | 12 |
| 4 | ' | 1 |
| 24 | N | 8 |
| 32 | O | 5 |
| 8 | P | 14 |
| 4 | Q | 40 |
| 24 | R | 8 |
| 16 | S | 7 |
| 24 | T | 6 |
| 16 | U | 9 |
| 8 | V | 17 |
| 8 | W | 16 |
| 4 | X | 24 |
| 8 | Y | 16 |
| 4 | Z | 40 |
| 8 | Blanks | 2 |

Figure 4:
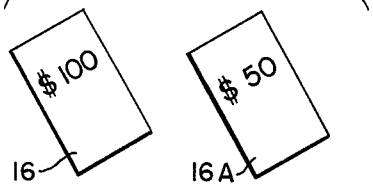
FIG. 4 is a perspective view of an exemplary dollar point certificates for use with the present invention.

The game apparatus also includes point stock certificates depicted graphically at 16, 16A in FIG. 4 with each game apparatus set being preferably provided with 33 of each denomination of $1, $2, $5, $10, $20, $50, $100, $500, and $1000.

Figure 5:
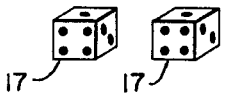
FIG. 5 is a perspective view of exemplary dice for use with the present invention.

Ordinary playing dice 17 (FIG. 5) are provided to control the movement of the player pieces 14 around the outer board portion 3, in a manner described in more detail below.

Figure 6:
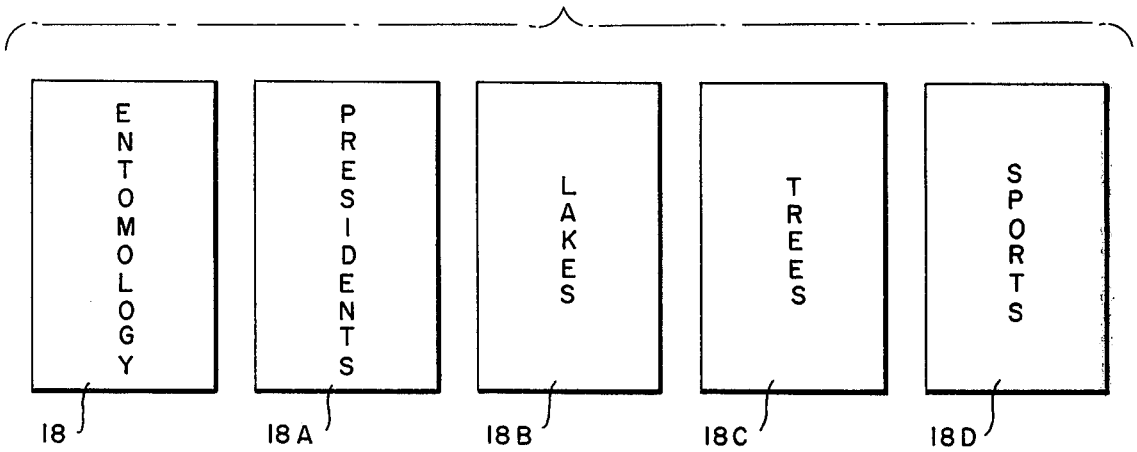
FIG. 6 schematically depicts the faces of a set of exemplary category cards for use with the present invention.
Figure 6A:
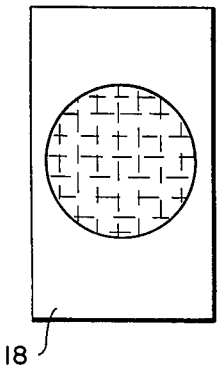
FIG. 6A schematically depicts the backs of the set of exemplary category cards shown in FIG. 6.
Figure 7:
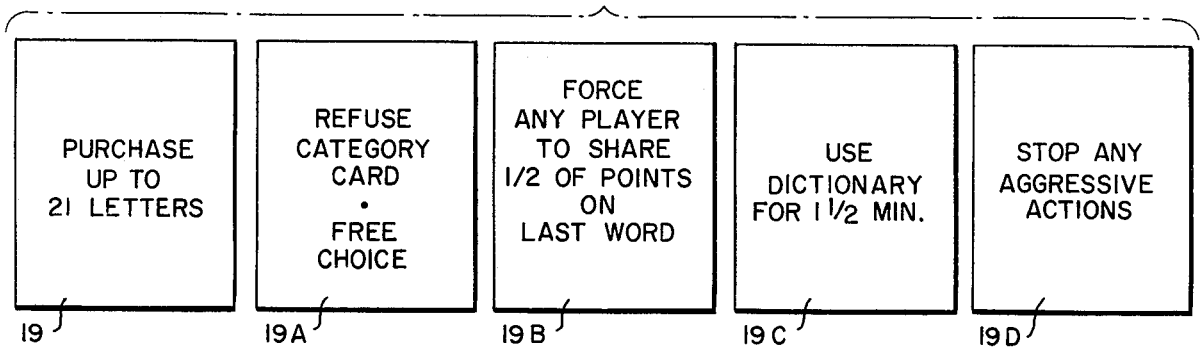
FIG. 7 schematically depicts the faces of a set of exemplary bonus cards for use with the present invention.
Figure 7A:
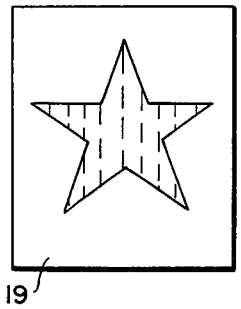
FIG. 7A schematically depicts the backs of the set of exemplary bonus cards shown in FIG. 7.
Figure 8:
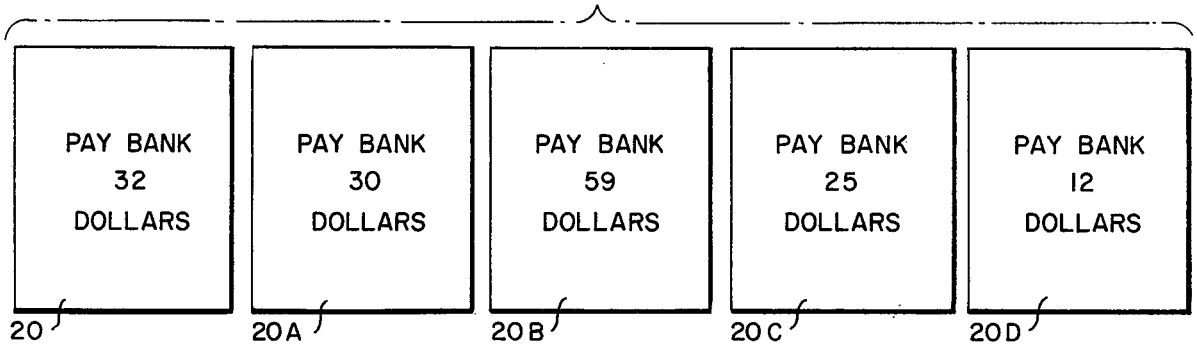
FIG. 8 schematically depicts the faces of a set of exemplary penalty cards for use with the present invention.
Figure 8A:
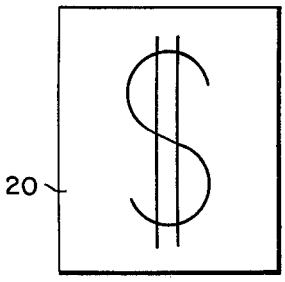
FIG. 8A schematically depicts the backs of the set of exemplary penalty cards shown in FIG. 8.

In addition to the above pieces, the game apparatus includes a plurality of category cards, schematically illustrated examples 18A, 18B, 18C, 18E, shown in FIG. 6. Also the game apparatus includes a plurality of bonus cards schematically illustrated examples 19A, 19B, 19C, 19D, 19E shown in FIG. 7. The bonus cards include stars at the backside thereof corresponding to the stars at spaces 12 of the board, while the category cards include colored circles corresponding to the colored circles at a spaces 11 of the game board. The game apparatus further includes penalty fines or library dues cards schematically illustrated examples 20A, 20B, 20C, 20D, 20E shown in FIG. 8. Each penalty includes a card back cover showing the dollar sign corresponding to the dollar sign at the spaces 13 on the board and the other side indicating the amount of points or dollars the player must forfeit or pay to the bank, upon drawing a particular card.

The specific symbols, coloration, and indicia, indicated on the game board and on the cards, playing pieces, letter pieces, and dollar point certificates may be altered from that shown, without departing from the scope of the invention. However, it is preferred that these symbols, indicia, and colors be selected to give a pleasing overall appearance to the game board and other game apparatus, while at the same time making it easy to recognize the particular type of space that a player piece is landing on in the outer board portion 3 and correlating the same with the category, bonus, or penalty cards. For example, it is especially preferred that each of these sets of cards have backs thereon which correspond in shape and coloration to the corresponding bonus, category, or penalty spaces on the game board.

The structure and arrangement of the various game pieces should be more fully understood from a description of the play of the game to follow.

Figure 9:
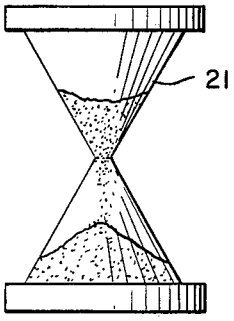
FIG. 9 schematically depicts a timer.

Another item that is used in preferred embodiments of the invention is a timing device, schematically depicted at 21 in FIG. 9. This timing device could be a simple, three-minute egg timer, or could be a stop watch apparatus, with or without a display or alarm signal.

PLAY OF THE GAME

Any number of players from 2–212 can play the game. The game is initiated by each player blindly drawing 21 letters from a letter box containing the supply of letter pieces 15, 15A referred to above. At the outset of the game, a bank is established to distribute the point certificates 16, 16A, etc. in the amount of $100 to each player. The bonus cards, category cards, and penalty cards are positioned on their respective spaces 7, 5, 6 of the board 1. These cards are preliminarily shuffled so that the location of the various cards in the stacks is random. Each player rolls the dice 17 to determine which player will start. All player pieces 14, 14A are positioned at space 8 of the outer board portion 3 of the board 1. The players seat themselves around the board 1 and play progresses in a clockwise fashion from the player who first rolls as determined by the preliminary roll of the dice 17. To facilitate play, an appropriate pivotal or lazy susan support is provided on the game board 1.

Actual play commences with the first player rolling the dice 17 to determine the number of spaces along the outer board portion 3 his player piece 14 shall be moved. After moving his player piece 14 the appropriate number of spaces, the player piece lands on one of the spaces at the outer portion 3 of the board. Depending upon the indicia on the particular space landed upon, the player than takes the appropriate action. For example, if the player piece lands on a free choice space 10, the player must then form a word on the inner portion 2 of the board, using the letters that he possesses and without any regard for the category or subject area from which the word must come. In preferred methods of playing the game, the words to be formed are restricted to nouns, proper nouns, adjectives, names, places, brand names, and contractions. As soon as the player has rolled the dice and moved his player piece to the indicated space, a timer is started which sets a predetermined maximum time within which the player must form the word. In preferred forms of the game, no more than three minutes should be allowed for the formation of the word, except in those instances wherein a bonus card is awarded allowing the player to consult a dictionary for an additional time period. In the absence of a bonus card, it is preferred that use of a dictionary be forbidden for forming words, but be allowed by other players contesting the accuracy or spelling of a word. The first player forming a word must place the letters on the board so that at least one letter is placed on the exact center square. All words formed subsequently thereto must incorporate at least one letter of one previously formed word.

In the event the player piece 14 lands on a category space 11, the player must draw a category card from the stack of category cards at space 5 and form a word that is encompassed by the category indicated on the category card drawn, within the same time limit set by the timer.

If a player piece lands on a bonus space 12, the player shall draw a bonus card from the stack of bonus cards at the bonus space 7 and take whatever action is indicated on the card, or optionally hold the card for the player's use at a later turn, in dependence on the player's chosen strategy.

In the event a player pieces lands on the spinner 9 or multiple gamble space, the player shall spin the spinner and take the appropriate action indicated on the face of the spinner. The spinner 9 is divided so as to establish a ratio of possibilities in the following manner. Of the 360° full circle sweep of the spinner 9, 135° are formed into free choice areas, wherein the player may form a word without restriction as to category; 45° are divided into a missed turn, wherein the player does not have any opportunity to form a word or take any further action; 45° are divided into a space requiring the player to pay to the bank ten times the roll of the dice; 25° are divided into instructions to move up one space; 25° are divided into moving up five spaces; and 45° are provided for the player to move the player piece directly to the penalty card base 6, in which case, the player would draw a penalty card and take the action indicated thereon.

In the event a player piece lands in a penalty space 13 and the player does not have sufficient money in hand to pay the bank the full amount of the card requirement, he has the option to sell some of his remaining letters to the other players or to the bank, with the players in turn having the right of first refusal. The price received for the letters is the same as the point certificate value for the given letter, which will be stamped visibly on each of the letter pieces. In the event the player cannot raise sufficient money to discharge the obligation of the penalty or library fine card, he is out of the game. In such an event, all letters of the terminated player are returned to the letter box supply.

Each time a player piece passes the start position or space 8, the player collects 50 point certificates from the bank, subject to variation in amount in the event the player at that time possesses bonus cards.

At any time when the player has a turn, the player may buy letter pieces by paying the point value of each letter piece in terms of the point certificate values from the bank.

For accumulating the score, the point certificate values or play money is used, with the player totalling the total value of the entire word formed by adding the point value of each letter, including multiples as determined by the colored squares of the inner board portion 2, as well as the multiples for word values. The player then withdraws point certificates from the bank having a face value equal to the amount of the score for the word.

The multiple values indicated in the colored spaces on the inner board portion 2 make it desirable for any successful player to take careful consideration thereof in locating and forming any particular word. This consideration is, of course, further complicated when a specific category must be adhered to.

The game is concluded in one of two fashions. For a so-called "short game", the players may agree in advance what number of turns each player will have and after each player has had that many turns, the total point certificates of each player are determined and the player with the most point certificates is the winner. For a long or complete game, the player who succeeds in using the last of his or her letters is the winner. If the game cannot be completed in this fashion, upon agreement of the players, the game can be terminated and the winner determined by counting the total of the point certificates minus the total value of all letters unplayed by each player, with the winner being the player with the highest net total.

The bonus cards in preferred arrangements of the game, include so-called "aggressive action" cards such as cards 19A through 19D, as well as a "stop aggressive action" card 19E. Since these bonus cards can be optionally retained and not utilized on a given turn of the player, certain of the players may accumulate "stop aggressive action" cards 19E. Then, at any time during the course of the game when another player attempts to cash in on his bonus card, such as by making a player share fifty percent of his points on the last word, the player holding the stop aggressive action card can trade the same for a cancellation of the other player's bonus card.

While we have shown and described several embodiments in accordance with the present invention, it is understood that the same is not limited thereto but is susceptible to numerous changes and modifications as known to those skilled in the art and we therefore do not wish to be limited to the details shown and described herein but intend to cover all such changes and modifications as are encompassed by the scope of the appended claims.

We claim:

1. A board game comprising:

a plurality of separate movable letter pieces, a plurality of separate movable player pieces, board means having first and second board areas which are each divided into a plurality of spaces, said first board area including spaces for accomodating placement of said letter pieces to form words, said second board area including spaces defining a path for said player pieces, and first random chance control means for controlling the movement of said player pieces along the path on said second board area, wherein at least some of said spaces on said second board area include indicia delineating a category of words that may be formed on said first board area for controlling a player's word forming options in dependence on the particular space occupied by said player's playing piece on said second board area, and further comprising a plurality of category cards which each delineate a category of words that may be formed, wherein the indicia for controlling a player's word forming options delineate said category by including indicia directing a player to draw one of the category cards.

2. A board game according to claim 1, wherein the indicia for controlling a player's word forming options include indicia directing a player to form a word without regard to category.

3. A board game according to claim 1, further comprising a plurality of point certificates depicting money amounts or the like, said point certificates being distributed from a bank to a player upon the formation of a word, the value of point certificates given to a player being dependent on the letter and word value of the word formed.

4. A board game according to claim 3, wherein said point certificates also constitute means by which players can purchase letter pieces from one another and from the bank under certain conditions.

5. A board game according to claim 1, further comprising a plurality of bonus cards which each delineate a bonus for the player drawing same, wherein at least some of said spaces on said second board area include indicia directing the player whose player piece lands thereon to draw one of the bonus cards and receive the bonus indicated.

6. A board game according to claim 1, further comprising a plurality of penalty cards which delineate a penalty for the player drawing same, wherein at least some of said spaces on said second board area include indicia directing the player whose player piece lands thereon to draw one of the penalty cards and suffer the penalty indicated.

7. A board game according to claim 1, further comprising a second random chance control means, wherein at least one of said spaces on said second board area includes indicia directing a player whose playing piece lands thereon to operate said second random chance control means and follow the instructions depicted by said second random chance control means.

8. A board game according to claim 7, wherein said first random chance control means are dice means, and wherein said second random chance control means is a spinner.

9. A board game according to claim 1, wherein the letter pieces also each include a number indicia reflecting their point certificate value, said point certificate value being determined as a function of the frequency of occurrence of the particular letter in words.

10. A board game according to claim 1, wherein said first board area includes rows and columns of spaces for accommodating arrangement of respective letter pieces in one of a row and column to form a word by a first player, with subsequent words being formed using at least one letter of a previously formed word.

11. A board game according to claim 10, wherein at least some of said spaces in the first board area include indicia indicating multiple values for letters and/or words having letters which occupy such spaces.

12. A board game according to claim 10, wherein said first board area is constituted by a square grid of said spaces arranged in columns and rows.

13. A board game according to claim 12, wherein said second board area includes a plurality of adjacent spaces which are arranged around the periphery of the first board area.

14. A board game according to claim 12, wherein the indicia for controlling a player's word forming options include indicia directing a player to form a word without regard to category.

15. A board game according to claim 14, further comprising a plurality of bonus cards which each delineate a bonus for the player drawing same wherein at least some of said spaces on said second board area include indicia directing the player whose player piece lands thereon to draw one of the bonus cards and receive the bonus indicated.

16. A board game according to claim 15, further comprising a plurality of penalty cards which delineate a penalty for the player drawing same, wherein at least some of said spaces on said second board area include indicia directing the player whose player piece lands thereon to draw one of the penalty cards and suffer the penalty indicated.

17. A board game according to claim 16, further comprising a second random chance control means, wherein at least one of said spaces on said second board area includes indicia directing a player whose playing piece lands thereon to operate said second random chance control means and follow the instructions depicted by said second random chance control means.

18. A board game according to claim 17, wherein said first random chance control means are dice means, and wherein said second random chance control means is a spinner.

19. A board game according to claim 18, wherein the letter pieces also each include a number indicia reflecting their point certificate value, said point certificate value being determined as a function of the frequency of occurrence of the particular letter in words.

20. A board game according to claim 19, wherein said second board area includes a plurality of adjacent spaces which are arranged around the periphery of the first board area.

21. A board game according to claim 20, further comprising timer means for controlling and/or monitoring the time for players to form words on said first board area.

22. A board game according to claim 1, further comprising timer means for controlling and/or monitoring the time for players to form words on said first board area.

23. A board game according to claim 1, wherein said first board area constitutes a common board area for use by all players and has sufficient spaces for accommodating placement of said letter pieces by all players to form words, and wherein said path defined by said second board area is a common path for movement of the movable pieces of all players and is peripherally bordering said first board area.

* * * * *